United States Patent [19]

Claussen

[11] 4,291,571

[45] Sep. 29, 1981

[54] FORGING PRESS

[75] Inventor: Paul O. Claussen, Willich, Fed. Rep. of Germany

[73] Assignee: Schloemann-Siemag Aktiengesellschaft, Dusseldorf, Fed. Rep. of Germany

[21] Appl. No.: 96,539

[22] Filed: Nov. 21, 1979

[30] Foreign Application Priority Data

Dec. 2, 1978 [DE] Fed. Rep. of Germany ..... 2852303

[51] Int. Cl.[3] ..... B21J 9/12

[52] U.S. Cl. ..... 72/453.18; 72/453.12; 72/455; 100/214; 100/269 R

[58] Field of Search ..... 72/453.18, 453.01, 453.09, 72/453.12, 455, 407, 441; 100/214, 269 R

[56] References Cited

U.S. PATENT DOCUMENTS 3,081,659 3/1963 Theobald ..... 100/269 R
3,158,046 11/1964 Steinfort ..... 100/269 R
3,353,397 11/1967 Hoffmann ..... 72/455
3,747,393 7/1973 Robra ..... 72/455

FOREIGN PATENT DOCUMENTS 245320 6/1963 Australia ..... 100/269 R
1259180 1/1968 Fed. Rep. of Germany .

*Primary Examiner*—Gene P. Crosby
*Attorney, Agent, or Firm*—Holman & Stern

[57] ABSTRACT

A forging press has a stationary cross head which carries a lower die, and a movable frame with an upper die carried in the part of the frame above the stationary cross head. A positioning piston/cylinder unit, operated by low pressure fluid, moves the frame to a predetermined position relative to the stationary cross head. The frame is then locked in position by pressurizing oppositely acting piston/cylinder units, and the upper die is moved to carry out a forging operation by a piston/cylinder unit located in the top of the frame and operated by high pressure fluid.

5 Claims, 1 Drawing Figure

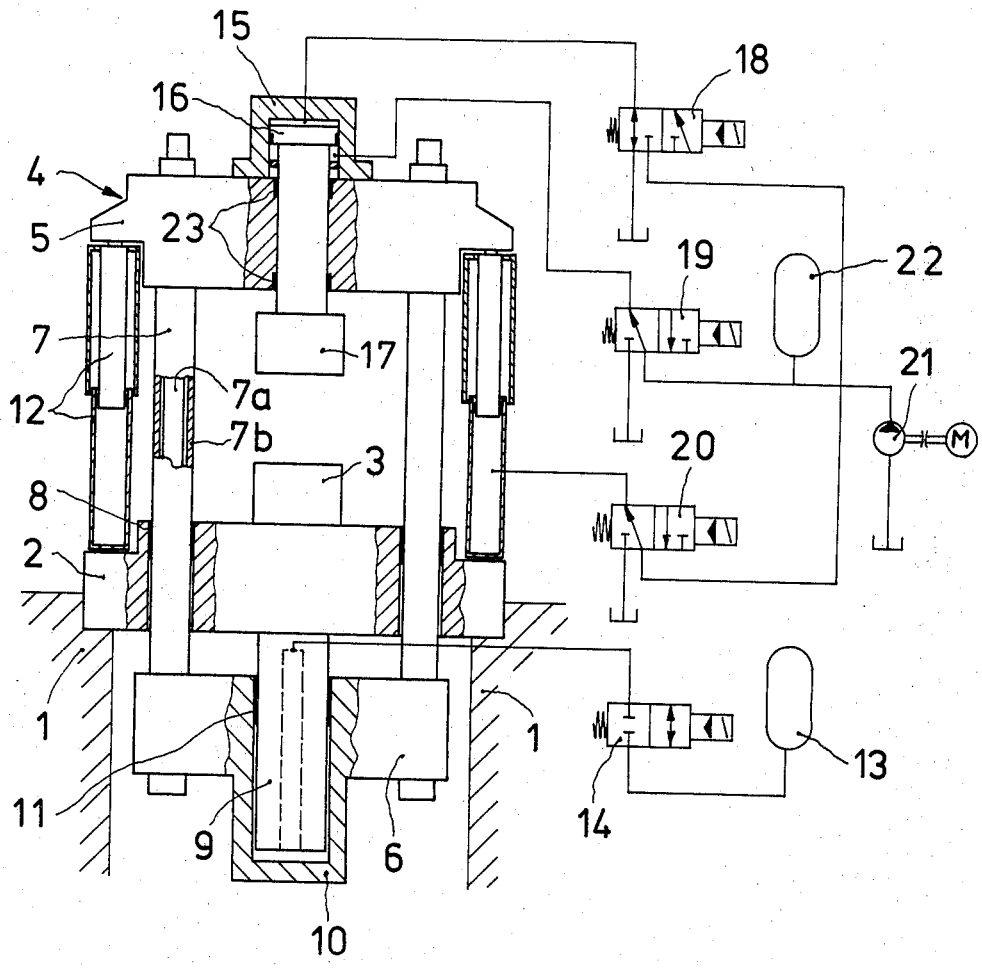
15
16
18
4
5
23
19
22
7
17
21
12
7a
7b
20
3
8
2
1
1
13
11
9
6
14
10
M

FORGING PRESS

FIELD OF THE INVENTION

The invention relates to a forging press, for example an open-die forging press of the underfloor-construction type.

BACKGROUND OF THE INVENTION

The most widely used constructional form of the underfloor forging press is the above ground type of construction.

In the above ground type of forging press, the drive is located between the upper cylinder cross head and the moving cross head which has an upper tool arranged below it. As known, this type of press has a relatively great structural height and, in consequence of the upper drive location, has a relatively high centre of gravity, which, taken together, also imply a relatively high workshop structure. On the other hand, the moving mass consists in this case only of the moving cross head with the upper tool and the plunger preferably connected therewith.

To lower the centre of gravity of the press and to reduce the structural height of the workshop, the underfloor-type construction of forging press was introduced, in which the drive is located below floor level between the fixed cross head, which also carries the lower die, and the bottom cross head—preferably constructed as the cylinder cross head. The bottom cross head, together with connecting members—usually columns—and the top cross head form a frame which carries the upper die. With each forging stroke, this frame is moved as a whole, whilst the fixed cross head remains stationary. The advantage of this construction is a low centre of gravity and the low structural height of the press above ground, which in turn implies lower and thus cheaper workshop structures. However, owing to the overall frame motion, the moving mass is greater than in the aboveground-type construction.

Thus, depending on the type of construction, the two types of press offer different advantages, but also different serious drawbacks.

For these reasons, in an open-die forging press of the underfloor type (German Patent Specification No. 1 259 180) an improvement was attempted to enable work to be carried out with high stroke frequency and low accelerations, at least during precision and high speed forging. This was achieved by means of a precision-forging or high-speed forging device accomodated in the head of the press frame. With this device, the press-frame itself need not be moved during precision and high-speed forging, so that the moving masses are substantially smaller. However, for hammer and percussion forging, with the corresponding greater stroke heights and pressing forces, the whole frame has still to be moved, whilst the drive itself is located below floor level. On the other hand, the risk of eccentric forging is particularly great precisely in hammer and percussion forging, owing to which the frame guides in the fixed cross head are subjected to particularly high stresses; furthermore, the foundation suffers owing to the high mass accelerations and decelerations producing corresponding shocks, quite apart from the intensive noise and vibrations produced even in the surroundings of the foundation.

The present invention starts from this state of the art. The following requirements are imposed on a forging press:

1. It must be precisely controllable, i.e., when provided with appropriate control devices it must
   - operate with a compression volume as small as possible, and
   - have an overrun (upper die stroke after "stop" instruction) as small as possible.
2. It must be able to be operated at as high a speed as possible, both in the large idle strokes with low force, and also in the short working strokes with pressing force.
3. It must be able to work with the largest possible number of strokes per unit of time.
4. It must be as rigid as possible, and must not wobble during operation.
5. It must be environmentally acceptable and, in particular, must not impose excessive dynamic loading on its own foundation.
6. In addition, it must be easy to maintain, economical and safe.

SUMMARY OF THE INVENTION

The invention provides a forging press having a fixed cross head, a die carrier on the fixed cross head for a lower die, a movable press frame comprising a top cross head above and a bottom cross head below the fixed cross head and tie beams connecting the top and bottom cross heads, vertically extending guides through the fixed cross head for guiding the tie beams so that the top cross head of the press frame is moved towards and away from the fixed cross head when the press frame is moved, a first piston/cylinder unit arranged between the fixed cross head and the bottom cross head a source of low pressure fluid connected to the first piston/cylinder unit via a closable valve, for moving the press frame relative to the fixed cross head, a second piston/cylinder unit associated with the top cross head, means for retracting the piston of said second unit, a die carrier for an upper die on one end of the piston of said second unit, means for operating said second unit to carry out a forging operation, retraction piston/cylinder units arranged between the top cross head and the fixed cross head, and a source of high pressure fluid connected to the retraction piston/cylinder units, said retraction units being arranged to operate in opposition to said first unit, when the valve of the fluid source for said first unit is closed, to hold the frame stationary while a forging operation is being carried out.

By these means, the underfloor-cylinder is dimensioned for absorbing the full pressing force, but is subjected only to low pressure and serves in co-operation with the retracting piston/cylinder units only as a positioning unit for the entire press frame, inclusive of the tool unit located on the upper cross head. Accordingly, in this case, the frame is moved only over a distance corresponding to the subsequent working of the thickness of the workpiece. The forging work proper with high-pressure operation is carried out when the press frame is stationary only by way of the working short-stroke piston/cylinder unit in the upper cross head.

In contrast to the German Patent Specification No. 1 259 180, in which the working strokes proper for hammer and percussion forging take place whilst the frame is in full movement driven by the underfloor-drive, in the present invention the frame is completely at rest during these forging operations. Accordingly, the frame guides are not subjected to eccentric loads beyond the formal extent of the frame displacement. Owing to the now much smaller masses of the work-stroke drive (working unit), the foundation is subjected to a substantially smaller loading during the whole of the forging process. The environmental effects are similarly milder for this reason.

According to a further feature of the invention, the low-pressure tank has water as pressure medium, whilst the forging piston/cylinder and the retracting units, operate with oil as pressure medium. The working volume of the operating medium required for the overall press stroke is subdivided in two partial volumes. The by far the largest volume is the only slightly compressible water volume in the lower positioning cylinder, coming from the low-pressure refill tank. The smaller volume of the more compressible oil is located in the short-stroke upper forging cylinder, and is supplied by the advantageously direct high-pressure pump drive or the high-pressure tank connected therewith, respectively. Owing to the fact, that in the lower, positioning cylinder a large volume of water is employed as pressure medium, the danger of environmental pollution is also reduced to a minimum. The same applies to a possible fire risk.

According to a further development of the invention, the motion sequences of the forging unit on one hand and that of the positioning unit on the other hand are so interlocked, that the forging unit in the upper cross head builds up the working pressure only when the connection between the positioning cylinder and the low-pressure tank is closed as is the connection between the positioning retractors and the high-pressure oil, whilst the positioning unit is movable only when the forging unit is switched to oil discharge. The lower, positioning unit thus works in cooperation with the lateral retractor piston/cylinder unit which are fed by the high-pressure oil pump drive. The positioning unit can move the frame into the desired position for the most favourable stroke length during forging. During forging the frame is stationary, after closing of the connection between positioning cylinder and low-pressure tank and after the positioning cylinder or cylinders are tensioned by the "positioning retractors" fed with high-pressure oil. Owing to the presence of water as pressure medium in the lower positioning cylinder or cylinders, which is of very low compressibility relative to the oil, a very precise and firm tensioning of the press frame is possible for the forging process in each case.

According to a further feature of the invention, the press frame is pretensioned by means of tension members arranged between the upper cross head and the lower cross head and compression members associated therewith, by which means a greater rigidity of the press frame and thus a more precise forging is made possible.

According to a further development of the invention, to simplify the retraction of the piston of the forging unit located in the upper cross head, the piston is a differential piston.

A particular advantage of the use of a differential piston in conjunction with the invention is to be seen in that a relatively simple and very precise "tailored" forging is possible, independently of the overshoot of the movable press portion after initiation of the "stop" switching instruction, and also independently of control tolerances.

For example, with a fully extended forging piston, which in its movement meets an inner stop, the position of the positioning piston or cylinder is calibrated by driving the upper die and the lower die against each other by means of the positioning unit. This would correspond to the "0" position.

For forging, the planned workpiece thickness is set in each case by the appropriate setting of the positioning cylinders and pistons relative to each other, after which the connection between positioning cylinders and low-pressure tank is closed. The forging to the precise set thickness of the workpiece is then effected by extending the differential piston of the forging unit in its stroke as far as the inner stop. This inner stop acts in each case as a mechanical stroke limit. A corresponding mechanical stroke limitation is known in forging hammers, where next to the workpiece a cold, gauge piece is placed on the lower die, which provides the hammer with a natural stroke limit.

The expansion of the machine frame, which was not taken into account in the above described calibration process, is compensated by a subsequent correction of the calibration setting on the basis of expansion measurements carried out once for all. However, it can also be taken into account as a fixed correction parameter during calibration.

DESCRIPTION OF A PREFERRED EMBODIMENT

An example of the invention will now be described with reference to a schematic drawing, showing an open-die forging press of the underfloor-construction type.

The fixed cross head or press table 2 of an open-die forging press of underfloor-type construction is fastened to a foundation 1. The cross head 2 carries a lower die 3 on its upper face. A prestressed pressframe 4, consisting of top cross head 5, bottom cross head 6 and interconnecting members 7 consisting of tension members *7a* and compression members *7b*, is guided for vertical movement in guides 8 of the cross head 2, which serve as upper guides. An underfloor piston 9 is fastened to the lower face of cross head 2, and this piston cooperates with an underfloor cylinder 10 mounted in bottom cross head 6, and guides the underfloor cylinder 10 and thus the entire frame 4 in guides 11 serving as lower guides. To the right and to the left of the connecting elements 7, here constructed as columns, retraction piston/cylinder units 12 are provided between the fixed cross head 2 and top cross head 5. These retraction cylinder/piston units 12 form, in cooperation with the underfloor piston 9 and underfloor cylinder 10, a positioning unit for the press frame 4, which moves as a whole relative to the fixed cross head 2.

Although these underfloor pistons and cylinders 9 and 10 are dimensioned for the maximum pressing force, they are operated with water through the underfloor piston 9 from a low-pressure tank 13, a closeable filling valve 14 being located between the underfloor piston 9 and the low-pressure tank 13. In consequence, the underfloor piston and cylinder 9, 10 do not serve as a drive unit, but, in cooperation with the retractor piston/cylinder units 12 only as a positioning unit for the press frame 4 as a whole.

In the top cross head 5 there is provided, as the drive unit, a driving cylinder 15, which cooperates with a short-stroke driving piston 16 sliding and guided therein. This driving piston 16, which in the present embodiment is a differential piston, carries on its shaft end or lower face an upper die 17.

Both the driving piston/cylinder unit 15, 16 and the retractor piston/cylinder units 12 are connected, respectively, through valves 18, 19 and 20, controllably to a high-pressure pump system 21 and a high-pressure tank 22 with oil as operating medium. Since the driving piston 16, which is guided in the driving cylinder 15 in cylindrical guides, and in the head beam 5 in resettable guides 23, is a differential or double-acting piston, special retractors for this "working unit" can be dispensed with.

The mode of functioning of this open-die forging press of underfloor-type construction is as follows:

The entire press frame 4, inclusive of the driving piston 16 and driving cylinder 15 located in the top cross head 5, is moved vertically by means of the underfloor positioning unit to a position where the upper die 17 is sufficiently close to the lower die 3 to carry out a forging operation on a workpiece. The determination of this position must take into account the maximum stroke of the piston 16. This movement is a low pressure operation powered from the low pressure tank 13, and does not involve any forging. Once this position has been reached the filling valve 14 between the low-pressure tank 13 and the underfloor piston 9 and cylinder 10 is closed and this "underfloor-positioning unit" is held rigid as a result of high pressure oil being fed via valve 20 to retractor piston/cylinder units 12. Forging storkes can now be carried out by admitting high pressure oil alternately via valves 18 and 19 to opposite sides of the head of piston 16. Hammer, percussion, precision and/or high-speed forging can be performed on this press. The valves 14, 18, 19 and 20 are interlocked so that valve 18 can only connect cylinder 15 and pump 21 when valves 14 and 20 are closed, and so that valve 14 can only connect cylinder 10 and fluid source 13 when valves 18, 19 and 20 allow their respective cylinders to be vented.

I claim:

1. A forging press having a fixed cross head, a die carrier on the fixed cross head, for a lower die, a movable press frame comprising a top cross head above and a bottom cross head below the fixed cross head, and tie beams connecting the top and bottom cross heads, vertically extending guides through the fixed cross head for guiding the tie beams so that the top cross head of the press frame is moved towards and away from the fixed cross head when the press frame is moved, a first piston/cylinder unit arranged between the fixed cross head and the bottom cross head, a source of low pressure fluid connected to the first piston/cylinder unit via a closable valve, for moving the press frame relative to the fixed cross head, a second piston/cylinder unit associated with the top cross head, means for retracting the piston of said second unit, a die carrier for an upper die on one end of the piston of said second unit, means for operating said second unit to carry out a forging operation, retraction piston/cylinder units arranged between the top cross head and the fixed cross head, and a source of high pressure fluid connected to the retraction piston/cylinder units, said retraction units being arranged to operate in opposition to said first unit, when the valve of the fluid source for said first unit is closed, to hold the frame stationary while a forging operation is being carried out.

2. The forging press of claim 1, wherein the low pressure fluid is water and the high pressure fluid, which is connected to the second piston/cylinder unit in addition to the retraction piston/cylinder units, is oil.

3. The forging press of claim 2, wherein valves are provided between the source of high pressure fluid and the second piston/cylinder unit and the retraction piston/cylinder units, respectively, and said valves are arranged with the closable valve of the low pressure fluid source in such a way that pressure can only build up in the second piston/cylinder unit when the valves connecting the first and retraction piston/cylinder units, with their respective fluid sources are closed, and that the first piston/cylinder unit can only move the frame when the valve associated with the retraction piston/cylinder unit permits discharge of fluid from the unit.

4. The forging press of claim 1, wherein the tie bars comprise prestressed tension and compression members interconnecting the top and bottom cross heads.

5. The forging press of claim 1 in which the piston of the second piston/cylinder unit is a differential piston.

* * * * *